US005174491A

United States Patent [19]

Taylor et al.

[11] Patent Number: 5,174,491

[45] Date of Patent: Dec. 29, 1992

[54] MATCHED MAILER FORM

[75] Inventors: Donald Taylor, Melbourne; Phillip Jones, Wodonza; Julie Ann Zarth, Melbourne, all of Australia

[73] Assignee: Moore Business Forms, Inc., Grand Island, N.Y.

[21] Appl. No.: 835,481

[22] Filed: Feb. 14, 1992

[51] Int. Cl.[5] ..... B65D 27/34; B65D 27/10

[52] U.S. Cl. ..... 229/92.1; 229/69; 229/314

[58] Field of Search ..... 229/69, 92, 92.1, 92.3, 229/307, 313, 314, 316

[56] References Cited

U.S. PATENT DOCUMENTS

| | | | |
|---|---|---|---|
| 2,710,716 | 6/1955 | Deutschmeister et al. | 229/73 |
| 2,873,907 | 2/1959 | Lortscher | 229/92.1 |
| 4,239,114 | 12/1980 | Denay | 229/314 |
| 4,375,868 | 3/1983 | Slotar et al. | 229/92.3 |
| 4,575,121 | 3/1986 | Conti | 281/2 |
| 4,927,072 | 5/1990 | Jenkins et al. | 229/92.3 |
| 4,944,449 | 7/1990 | Schmidt | 229/73 |
| 4,981,251 | 1/1991 | Jenkins et al. | 229/92.3 |

FOREIGN PATENT DOCUMENTS

| | | | |
|---|---|---|---|
| 67753 | 8/1892 | Fed. Rep. of Germany | 229/92.1 |
| 597326 | 11/1925 | France | 229/92.1 |
| 17012 | of 1910 | United Kingdom | 229/92.3 |

*Primary Examiner*—Allan N. Shoap
*Assistant Examiner*—Jes F. Pascua
*Attorney, Agent, or Firm*—Nixon & Vanderhye

[57] ABSTRACT

Intermediates for matched mailer type business forms are constructed in four and six panel formats from a single sheet. Pressure sensitive adhesive discontinuous strips are disposed in marginal portions of the intermediates to align with each other when the intermediates are folded first about a center line, and then either a single longitudinal fold line, or first and then second longitudinal fold lines. The adhesive strips may include L-shaped portions at the intersections of strips. The marginal portions are separated from four or six main panels by perforations. The marginal portions adjacent the longitudinal edges of the sheet may have tractor drive openings. Using the invention standard size mailers containing multiple plies may each be constructed from a single sheet, by running the intermediates through a non-impact printer (e.g. in continuous format), folding about the fold lines, and then running the mailers through a pressure sealer to apply pressure only along the marginal portions, and seal the adhesive at the marginal portions.

9 Claims, 3 Drawing Sheets

*Fig. 1*
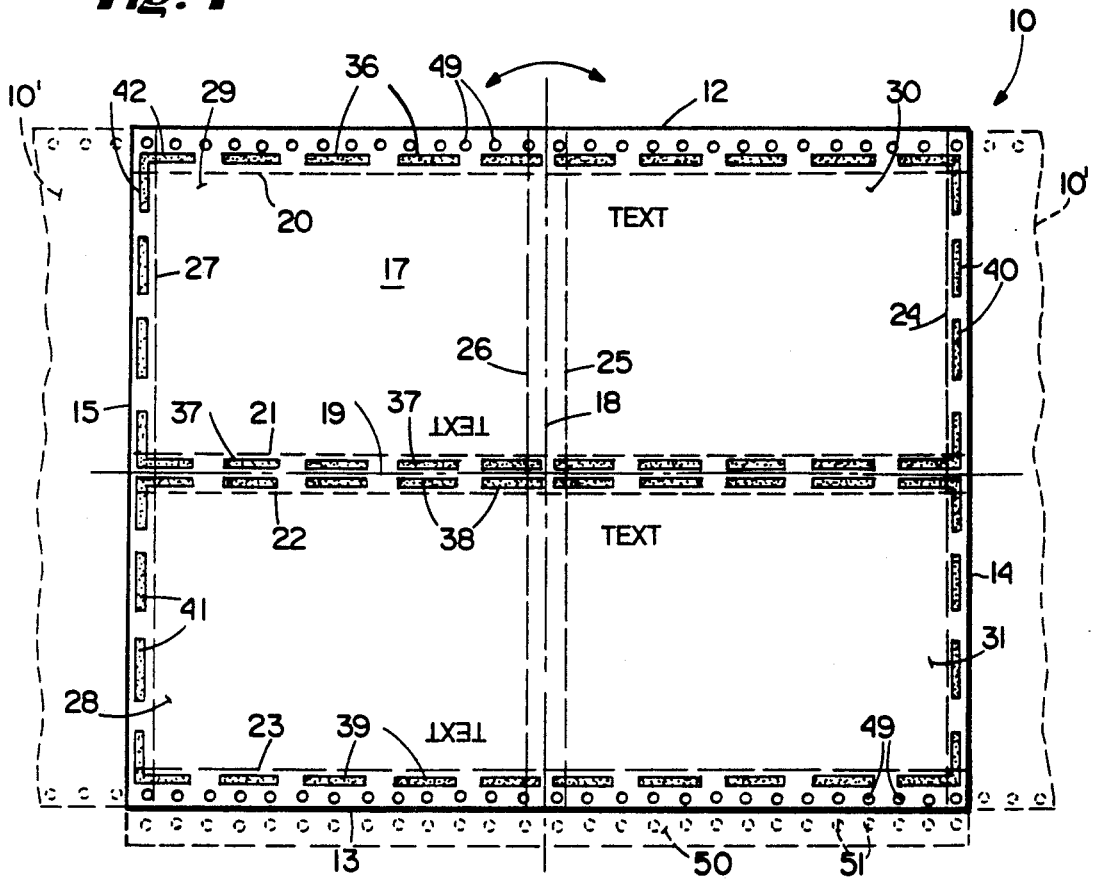
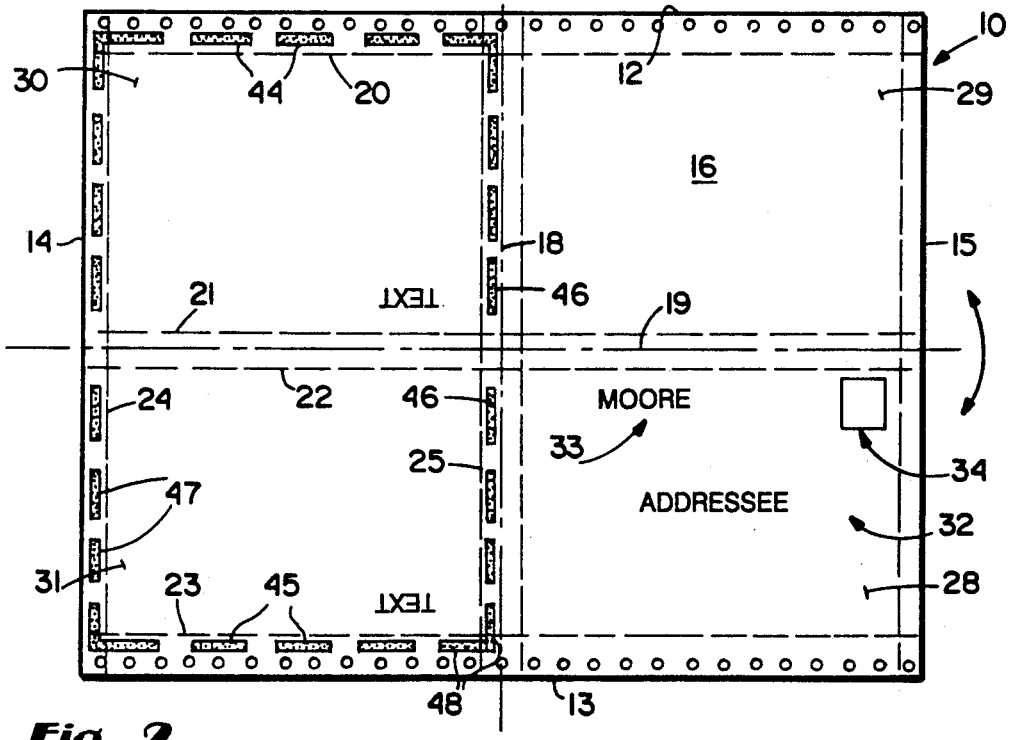
*Fig. 2*

Fig. 5
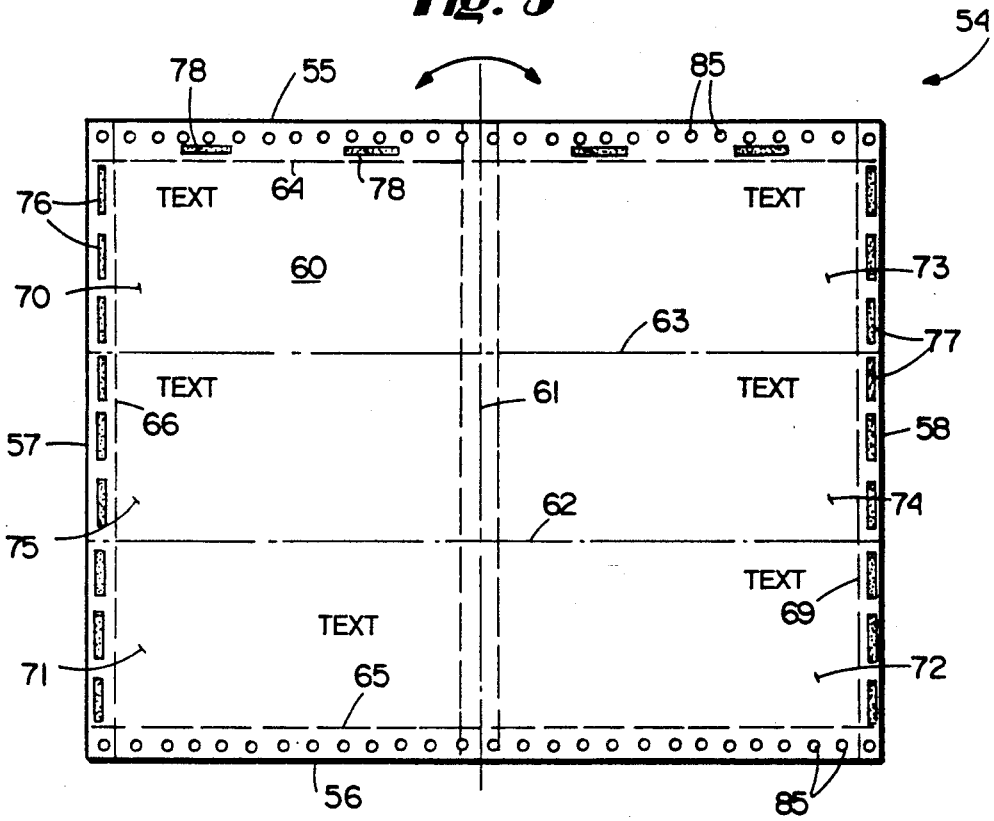
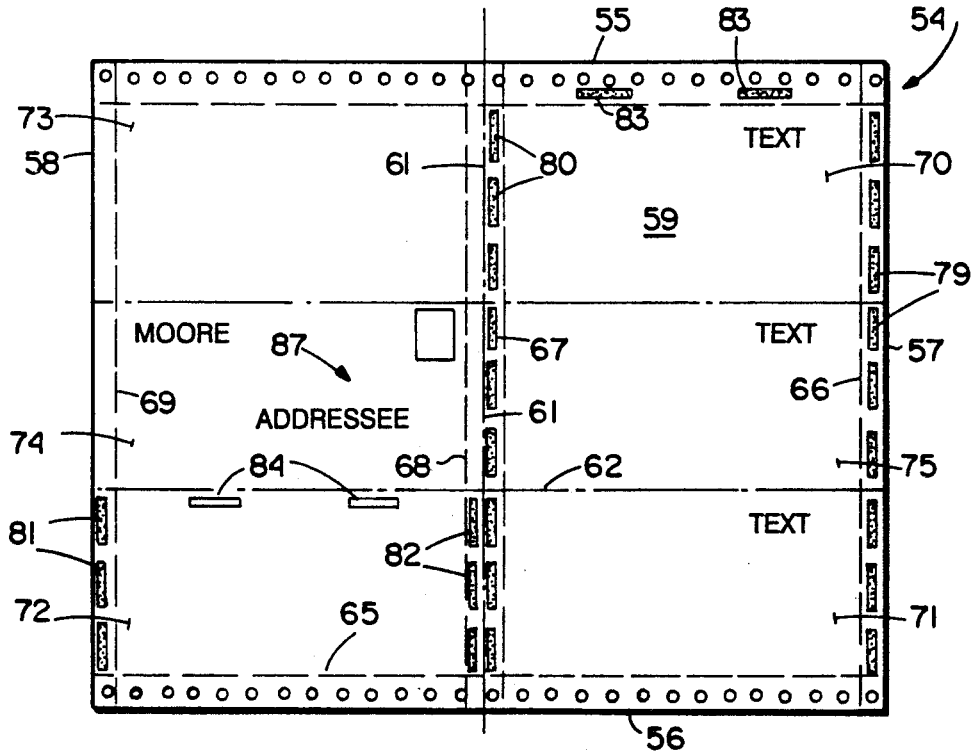
Fig. 6

MATCHED MAILER FORM

BACKGROUND AND SUMMARY OF THE INVENTION

In the production of mailer type business forms, it is sometimes necessary to provide a great deal of information on the mailer, which is desirably imprinted by a computer controlled printer, particularly a non-impact printer. One particularly simple way to produce such mailers, such as shown conceptually by U.S. Pat. Nos. 4,375,868, 4,927,072, and 4,944,449, is to produce the mailers from intermediates which comprise a single sheet of paper having a quadrate configuration with a pair of longitudinal edges, first and second side edges, and first and second faces. The intermediates are run through the computer controlled printer, typically driven by tractor drive holes formed in marginal portions of the intermediate, and then are folded into four or six panels to produce a final mailer.

According to the present invention, a mailer intermediate, and a method of constructing a mailer from the intermediate, are provided which facilitate the production of mailers containing a great deal of information, from single sheets, utilizing pressure sensitive adhesive to seal the components together. The pressure sensitive adhesive may be of the type sold by Toppan Moore of Japan under the designation TM124, and it is designed to be used in the Moore SPEEDISEALER ® pressure seal system, which is extremely advantageous in producing mailers without requiring equipment necessary for activating heat sensitive adhesives.

According to one aspect of the present invention a mailer intermediate, for producing a mailer having four panels, is provided. The mailer intermediate comprises: A single sheet of paper having a quadrate configuration with a pair of longitudinal edges, first and second side edges, and first and second faces. A center fold line essentially bisecting the longitudinal edges and extending therebetween essentially perpendicular thereto. A longitudinal fold line essentially bisecting the side edges and extending therebetween essentially perpendicular thereto. Means defining lines of weakness spaced from each of the edges and fold lines to define marginal portions and four quadrate main panels, the main panels of essentially identical size. A first plurality of pressure sensitive adhesive patterns disposed in the marginal portions on the second face along the side edges, longitudinal edges, and longitudinal fold lines. And, a second plurality of pressure sensitive adhesive patterns disposed in the marginal portions on the first face in the marginal portions along the first side edge, and half of each of the longitudinal edges adjacent the first side edge, and adjacent the center fold line in the marginal portion closest to the first side edge.

The first and second pluralities of pressure sensitive adhesive patterns may comprise discontinuous strips of pressure sensitive adhesive which align with like strips in cooperating marginal portions when the intermediate is folded about the fold lines. The discontinuous strips of pressure sensitive adhesive may comprise L-shaped portions at the corners at which the strips intersect. Typically the second face marginal portions adjacent the center fold line are devoid of adhesive patterns except where intersected by the longitudinal fold line and the longitudinal edges, in order to minimize the thickness of the marginal portions of the mailer. Similarly, the first face marginal portions adjacent the longitudinal fold line between the first side edge and the center fold line are devoid of adhesive patterns. One of the panels between the second side edge and the center fold line on the first face preferably address indicia printed thereto to indicate the addressee of a mailer produced from the intermediate.

The invention also comprises a method of constructing a mailer utilizing the intermediate described above. The mailer is produced by the steps of substantially sequentially: (a) Feeding the intermediate through a non-impact printer so as to print indicia on the first and/or second faces thereof. (b) Folding the intermediate about the center fold line so that the first plurality of adhesive patterns on the the second face thereof are moved into cooperating relationship with each other. (c) Folding the intermediate about the longitudinal fold line so that the second plurality of adhesive patterns on the first face thereof are moved into cooperating relationship with each other. And, (d) applying pressure to only the marginal portions of the intermediate containing adhesive patterns to seal all the cooperating adhesive patterns to each other.

Step (a) is preferably practiced to print outgoing address information on one of the panels between the second side edge and the center fold line on the first face of the intermediate, and step (a) is further practiced by utilizing tractor feed openings in the marginal portions of the intermediate along the longitudinal edges thereof. The intermediate may be in continuous format, being connected to like intermediates along the side edges thereof, in which case there is the further step, between steps (a) and (b), of bursting the continuous intermediates along the side edges.

According to another aspect of the present invention, a six panel mailer intermediate is provided. That intermediate comprises: A single sheet of paper having a quadrate configuration with a pair of longitudinal edges, first and second side edges, and first and second faces. A center fold line essentially bisecting the longitudinal edges and extending therebetween essentially perpendicular thereto. First and second longitudinal fold lines essentially trisecting the side edges and extending therebetween essentially perpendicular thereto, and parallel to each other and the longitudinal edges. Means defining lines of weakness spaced from each of the edges and the center fold line to define marginal portions and six quadrate main panels, the main panels of essentially identical size, including four end panels, and two center panels. A first plurality of pressure sensitive adhesive patterns disposed in the marginal portions adjacent the side edges and one of the longitudinal edges on the second face. A second plurality of pressure sensitive adhesive patterns disposed on the first face in the marginal portions along the first side edge, and adjacent the center fold line in the marginal portion closest to the first side edge. And, a third plurality of pressure sensitive adhesive patterns disposed on the first face in the marginal portions along the second side edge, and adjacent the center fold line in the marginal portion closest to the second side edge, in one, and only one, of the end panels. The longitudinal fold lines may comprise lines of weakness.

There also may be provided fourth pressure sensitive adhesive patterns disposed in the marginal portions on the first face adjacent the longitudinal edge most remote from the first fold line, and in one panel adjacent the second longitudinal fold line. The fourth pressure sensitive adhesive patterns align when the intermediate is folded about the center fold line, first longitudinal fold line, and then second longitudinal line, respectively.

The invention also contemplates a method of constructing a mailer utilizing the six panel intermediate described above. The method comprises the steps of substantially sequentially: (a) Feeding the intermediate through a non-impact printer so as to print indicia on the first and/or second faces thereof. (b) Folding the intermediate about the center fold line so that the first plurality of adhesive patterns on the second face thereof are moved into cooperating relationship with each other. (c) Folding the intermediate about the first longitudinal fold line so that some of the second plurality of adhesive patterns on the first face thereof are moved into cooperating relationship with each other. (d) Folding the intermediate about the second longitudinal fold line so that the third plurality of adhesive patterns on the first face thereof are moved into cooperating relationship with the remaining portions of the second plurality of adhesive patterns. And, (e) applying pressure to only the marginal portions of the intermediate containing adhesive patterns to seal all the cooperating adhesive patterns to each other into a final mailer having six aligned main panels.

It is the primary object of the present invention to provide a matched mailer from an intermediate, and utilizing the method, specifically designed to accommodate pressure sensitive adhesive to effect sealing of the mailer components together. This and other objects of the invention will become clear from an inspection of the detailed description of the invention, and from the appended claims.

BRIEF DESCRIPTION OF THE DRAWINGS

FIG. 1 is a top plan view of a second face of a four panel intermediate according to the invention;

FIG. 2 is a view like that of FIG. 1 for the first face of the intermediate of FIG. 1;

FIGS. 5 and 6 are top plan views of the second and first face, respectively, of an exemplary six panel mailer according to the invention;

DETAILED DESCRIPTION OF THE DRAWINGS

Figure 4:
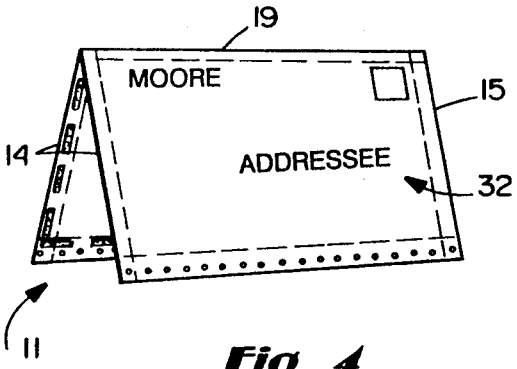
FIG. 4 is a top perspective view showing folding of the intermediate of FIG. 3 about the longitudinal fold line to produce the final mailer.

An exemplary four panel intermediate according to the present invention is shown schematically by reference numeral 10 in FIGS. 1 and 2, which is used to produce a mailer illustrated schematically at reference numeral 11 in FIG. 4. The intermediate 10 comprises a single sheet of paper which may be in sheet format, or—as shown by the dotted line portions 10'—may be part of a continuous form web. The intermediate 10 has a quadrate (square or rectangular) configuration with a pair of longitudinal edges 12, 13, first and second side edges 14, 15, respectively, a first face 16 (see FIG. 2), and a second face 17 (see FIG. 1). If in continuous form, the side edges 14, 15 thereof are perforations or like lines of weakness which may easily be detached from the continuous portions 10' on either side thereof.

The intermediate 10 further comprises a center fold line 18 essentially bisecting the longitudinal edges 12, 13 and extending between them, and essentially perpendicular to them. A longitudinal fold line 19 is also provided, which essentially bisects the side edges 14, 15 and extends between them, essentially perpendicular to them. That is the center fold line 18 is essentially parallel to the side edges 14, 15, and the longitudinal fold line 19 is essentially parallel to the longitudinal edges 12, 13.

Means are provided defining lines of weakness spaced from each of the edges 12 through 15 and the fold lines 18, 19 to define marginal portions and four quadrate main panels, the main panels of essentially identical size. The lines of weakness are illustrated in the form of perforations in FIGS. 1 and 2, including the perforations 20 through 27, and which define four panels 28 through 31. The panel 28 may have addressee indicia 32 printed on the first face 16 thereof (see FIG. 2), as well as return address indicia 33, and postage location indicia 34. Typically text will be printed on both the first and second faces of the panels 30, 31, as well as the second face 17 of the panels 28, 29, but typically no indicia is printed on the first face 16 of panel 29 (see FIG. 2).

The mailer 10 also comprises a first plurality of pressure sensitive adhesive patterns disposed in the marginal portions on the second face 17 along the side edges 14, 15, the longitudinal edges 12, 13, and the longitudinal fold line 19 (see FIG. 1). That is pressure sensitive adhesive patterns 36 through 41 are provided, respectively, in the marginal portions between the edge 12 and perforation 20; perforation 21 and fold line 19; fold line 19 and perforation 22; perforation 23 and longitudinal edge 13; side edge 14 and perforation 40; and perforation 27 and side edge 15. As illustrated in FIG. 1, the pressure sensitive adhesive patterns preferably are in the form of discontinuous strips of adhesive, which comprise L-shaped portions (e.g. the portion 42 illustrated in FIG. 1) at the corners at which the strips 36 through 41 intersect. The pressure sensitive adhesive preferably is that available from Toppan Moore of Japan and sold under the designation TM-124, a styrene-natural rubber copolymer. However it also can be pressure sensitive adhesive commercially available under the designation Fuller HL-9016, or any like compatible, pressure sensitive adhesive suitable for use with pressure sealing equipment such as the SPEEDISEALER® pressure sealer system sold by Moore Business Forms, Inc. of Lake Forest, Ill.

The mailer 10 further comprises (see FIG. 2) a second plurality of pressure sensitive adhesive patterns 44–47 which are disposed, respectively, adjacent the longitudinal edge 12 between first side edge 14 and the center fold line 18, adjacent the longitudinal edge 13 between the side edge 14 and the center fold line 18, adjacent the center fold line 18 at the marginal portion closest to the side edge 14, and adjacent the first side edge 14. That is the pattern 44 is between the longitudinal edge 12 and the perforation 20, the pattern 45 is between the longitudinal edge 13 and perforation 23, the pattern 46 is disposed between fold line 18 and the perforation 25, and the pattern 47 is disposed between the first side edge 14 and the perforation 24. In this case, as for the first plurality of pressure sensitive adhesive patterns, the patterns 44 through 47 are preferably in the form of discontinuous strips, again with L-shaped portions (see portion 48 for example) where they intersect.

It is also noted—especially where the mailer 10 is in continuous format in order to positively drive it through a non-impact printer or the like—that it is desirable to provide tractor drive openings in the intermediate 10. In the exemplary embodiment illustrated in solid line in FIGS. 1 and 2, tractor drive openings 49 are provided in the marginal portion adjacent both the longitudinal edges 12, 13. However it is to be understood that if it is desirable to separate out the tractor drive portions before the final mailer 11 is constructed, the openings 49 can be eliminated and accessory marginal portions (see portion 50 shown in dotted line in FIG. 1) with drive openings (51) may be provided, separated by perforations or other lines of weakness from the edges 12, 13, and removed after the intermediate 10 has been driven through the printer, but before folding.

It is noted that in the intermediate 10 adhesive patterns are not provided where unnecessary to properly seal the final mailer 11, in order to minimize the thickness of the marginal portions. That is, the marginal portions between the fold line 18 and perforations 25, 26 on the second face 17 (see FIG. 1), and the marginal portions between the fold line and the perforations 21, 22 on the second face 16 (see FIG. 2) are devoid of adhesive patterns, as of course is the entire first face of the panels 28, 29.

While the dimensions of the intermediates 10 may vary widely, it is of course desirable to make the intermediate 10 so that when folded into four panels it forms a standard mailing size mailer 11. For example, for international usage, the intermediate 10 may have an A3 size and fold into an A5 mailer 11 (see FIG. 4). For the United States, it may initially have an 11×15 inch or 11×17 inch size.

In the practice of the method according to the invention for making the mailer 11 (FIG. 4) from the intermediate 10 (FIGS. 1 and 2), the first step is feeding the intermediate 10 through a non-impact printer so as to print indicia on the first and/or second faces 16, 17 thereof. Certainly at least the address information 32 is printed by the printer, as very well may be a number of portions of the text on any one of the panels 28 through 31, and either face thereof. Typically the feeding is accomplished while the intermediate is in continuous web format (see FIG. 1), utilizing the tractor drive openings 49 to drive the intermediate 10 through the printer.

Figure 3:
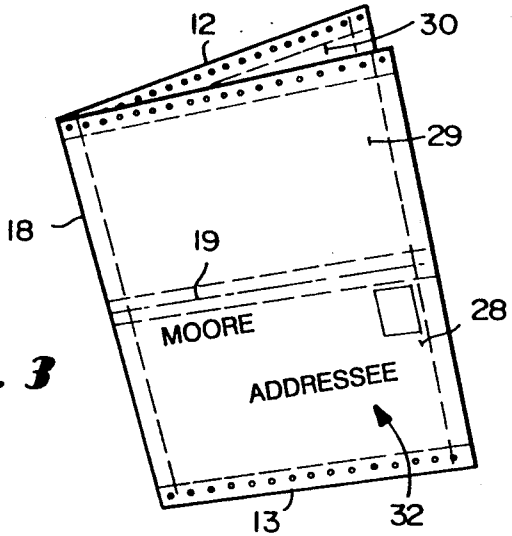
FIG. 3 is a top perspective view showing folding of the intermediate of FIGS. 1 and 2 about the center fold line.

After printing (and bursting along the edges 14, 15 if the intermediate is in continuous format), the next step is to fold the intermediate 10 about the center fold line 18, as illustrated schematically in FIG. 3. When folded about the center fold line 18, the adhesive patterns 40, 41 align with each other, as do the right and left halves of the patterns 36 through 39. Folding may be accomplished on any conventional automatic folding equipment suitable for that purpose, or by hand.

To produce the final mailer from the configuration of the intermediate of FIG. 3, the next step is to fold about the longitudinal fold line 19. The intermediate 10 is folded about the fold line 19 so that the adhesive patterns 44, 45 come into alignment with each other, as do the top and bottom halves of the adhesive patterns 46, 47.

The last step to produce the final mailer 11 from the form of the mailer 11 illustrated in FIG. 4 is to pass the mailer through conventional pressure seal equipment. The seal equipment utilized is preferably the Moore SPEEDISEALER® pressure seal system, which passes the form first in one direction, and then in another, perpendicular, direction, through sets of rollers which engage only the marginal portions of the mailer 11 (that is at the adhesive strips), applying substantial pressure thereto and thereby permanently sealing all of the cooperating adhesive strips, as described above, together.

FIGS. 5 and 6 illustrate a second form of a mailer intermediate according to the invention, generally by reference numeral 54. A final mailer produced utilizing the intermediate of FIGS. 5 and 6 can be gleaned from an inspection of FIG. 8, the final mailer having the configuration illustrated generally by reference numeral 55 in FIG. 8.

The mailer intermediate 54 also comprises a single sheet of paper having a quadrate configuration with a pair of longitudinal edges 55, 56, first and second side edges 57, 58, a first face 59 (see FIG. 6) and a second face 60 (see FIG. 5). A center fold line 61 essentially bisects the longitudinal edges 55, 56, being perpendicular thereto, and parallel to the side edges 57, 58. First and second longitudinal fold lines 62, 63, respectively, are provided, which essentially trisect the side edges 57, 58 and extend between them perpendicular to them, and parallel to each other and the longitudinal edges 55, 56. The longitudinal fold lines 62, 63 may comprise lines of weakness, such as perforations, if desired.

The intermediate 54 also comprises means defining lines of weakness (e.g. perforations) 64 through 69 spaced from each of edges 55 through 58 and center fold line 61 (but preferably not the longitudinal fold lines 62, 63) to define marginal portions and six quadrate main panels, the main panels of essentially identical size, including four end panels and two center panels. That is end panels 70, 71, 72, and 73 are provided as well as center panels 74 and 75.

The intermediate 54 further comprises a first plurality of pressure sensitive adhesive patterns disposed in the marginal portions adjacent the side edges and one of the longitudinal edges (or both longitudinal edges if desired) on the second face 60 (see FIG. 5). For example the pressure sensitive adhesive patterns can take the form of a discontinuous adhesive strip 76 disposed between the side edge 57 and the perforation 66, the discontinuous strip 77 disposed in the marginal portion between the side edge 58 and the perforation 69, and the discontinuous strip 78 disposed in the marginal portion between the longitudinal edge 55 and the perforation 64.

The intermediate 54 also preferably comprises a second plurality of pressure sensitive adhesive patterns disposed on the first face 59 (see FIG. 6) in the marginal portions along the first side edge 57 and adjacent the center fold line 61 in the marginal portion closest to the first side edge 57. The second plurality of pressure sensitive adhesive patterns, as illustrated in FIG. 6, may take the form of the discontinuous strips 79, 80, respectively. Also a third plurality of pressure sensitive adhesive patterns may be provided on the first face 59, in the marginal portion between the second side edge 58 and the perforation 69, and in the marginal portion between the center fold line 61 and the perforation 68. For example the third plurality of patterns may take the form of the discontinuous strips 81, 82 seen in FIG. 6. Finally, if desired, a fourth pressure sensitive adhesive pattern may be provided disposed in the marginal portions on the first face 59 (see FIG. 6) adjacent the longitudinal edge 55 most remote from the first fold line 62, and in the panel 72 adjacent the first fold line 62. The fourth patterns may be in the form of the discontinuous strips 83, 84 illustrated in FIG. 2.

In this embodiment, as in the FIGS. 1 through 4 embodiment, tractor drive openings 85 may be provided in the marginal portions between the longitudinal edge 55 and perforation 64, and perforation 65 and longitudinal edge 56, and the intermediate 54 may be in continuous form if desired. Alternatively, tractor feed openings may be provided in accessory marginal portions, such as illustrated at 50 in FIG. 1.

Figure 8:
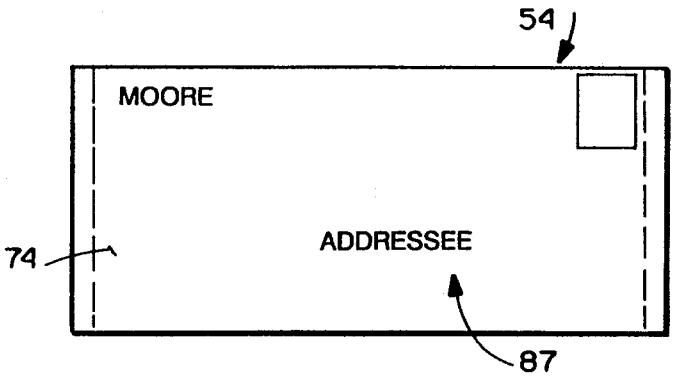
FIG. 8 is a top plan view of the front face of the final mailer produced from the intermediate of FIGS. 5 and 6.
Figure 7:
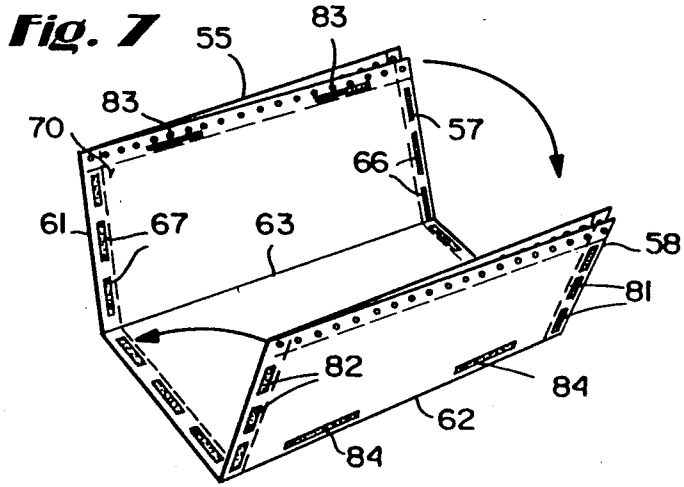
FIG. 7 is a top perspective view showing a mailer being formed from the intermediate of FIGS. 5 and 6 after having already been folded about the center fold line, while being folded about the first and second fold lines.

The intermediate 54 of FIGS. 5 and 6 is formed into a mailer first by feeding it through a non-impact printer to print one or both of the faces 59 to 60, and to at least print the address information 87 on the first face 59 of the center panel 74. Then it is folded about the center line 61 so that the adhesive patterns 76, 77 come in contact with each other, as well as the left and right halves of the pattern 78. Then it is folded, as illustrated in FIG. 7, first about the first fold line 62, and then about the second fold line 63, to first bring some of the second plurality of adhesive patterns 66, 67 (those on panels 71 and 75) into cooperating relationship with each other, and then so that the third adhesive patterns 81, 82 are brought into cooperating relationship with the adhesive patterns of the second plurality of patterns on the panel 70, as well as the fourth adhesive patterns 83, 84 being brought into association with each other. Then the intermediate is run through the Moore SPEEDISEALER® pressure seal equipment or the like to seal all the adhesive patterns, to produce the final mailer 55 as illustrated in FIG. 8.

It will thus be seen that according to the present invention a simple yet effective intermediate is provided which allows the production of the mailer having a great deal of technical information thereon from a single sheet of paper, and having the advantages of pressure seal adhesive patterns. The intermediate may readily be run through a computer printer to print variable information thereon, and then easily burst (if necessary) and folded into the desired final configuration.

While the invention has been herein shown and described in what is presently conceived to be the most practical and preferred embodiment, it will be apparent to those of ordinary skill in the art that many modifications may be made within the scope of the invention, which scope is to be accorded the broadest interpretation of the appended claims so as to encompass all equivalent structures and methods.

What is claimed is:

1. A mailer intermediate comprising:

a single sheet of paper having a quadrate configuration with a pair of longitudinal edges, first and second side edges, and first and second faces;

a center fold line essentially bisecting said longitudinal edges and extending therebetween essentially perpendicular thereto;

a longitudinal fold line essentially bisecting said side edges and extending therebetween essentially perpendicular thereto;

means defining lines of weakness spaced from each of said edges and fold lines to define marginal portions and four quadrate main panels, said main panels of essentially identical size;

a first plurality of pressure sensitive adhesive patterns disposed in said marginal portions on said second face along said side edges, longitudinal edges, and longitudinal fold line; and a second plurality of pressure sensitive adhesive patterns disposed in said marginal portions on said first face in said marginal portions along said first side edge, and half of each of said longitudinal edges adjacent said first side edge, and adjacent said center fold line in the marginal portion closest to said first side edge.

2. An intermediate as recited in claim 1 wherein said marginal portions adjacent said longitudinal edges include means defining tractor drive openings.

3. An intermediate as recited in claim 1 wherein said lines of weakness are perforations.

4. An intermediate as recited in claim 1 wherein said first and second pluralities of pressure sensitive adhesive patterns comprise discontinuous strips of pressure sensitive adhesive which align with like strips in cooperating marginal portions when said intermediate is folded about said fold lines.

5. An intermediate as recited in claim 4 wherein said discontinuous strips of pressure sensitive adhesive comprise L-shaped portions at the corners at which said strips intersect.

6. An intermediate as recited in claim 1 wherein said second face marginal portions adjacent said center fold line are devoid of adhesive patterns except where intersected by said longitudinal fold line and said longitudinal edges.

7. An intermediate as recited in claim 6 wherein said first face marginal portions adjacent said longitudinal fold line between said first side edge and said center fold line are devoid of adhesive patterns.

8. An intermediate as recited in claim 1 wherein said first face marginal portions adjacent said longitudinal fold line between said first side edge and said center fold line are devoid of adhesive patterns.

9. An intermediate as recited in claim 1 wherein one of said panels between said second side edge and said center fold line on said first face has address indicia printed thereon to indicate the addressee of a mailer produced from the intermediate.

* * * * *